US008869340B2

(12) United States Patent
Lee

(10) Patent No.: US 8,869,340 B2
(45) Date of Patent: Oct. 28, 2014

(54) TOOTHBRUSH

(75) Inventor: Pal Hyung Lee, Daegu (KR)

(73) Assignee: Neob Co., Ltd., Busan (KR)

( * ) Notice: Subject to any disclaimer, the term of this patent is extended or adjusted under 35 U.S.C. 154(b) by 0 days.

(21) Appl. No.: 14/115,100

(22) PCT Filed: May 9, 2011

(86) PCT No.: PCT/KR2011/003429

§ 371 (c)(1),
(2), (4) Date: Feb. 5, 2014

(87) PCT Pub. No.: WO2012/153878

PCT Pub. Date: Nov. 15, 2012

(65) Prior Publication Data

US 2014/0137355 A1 May 22, 2014

(51) Int. Cl.

| | |
|---|---|
| ***A46B 7/06*** | (2006.01) |
| ***A46B 9/04*** | (2006.01) |
| ***A46B 5/00*** | (2006.01) |

(52) U.S. Cl.

CPC ... *A46B 9/04* (2013.01); *A46B 7/06* (2013.01); *A46B 5/0066* (2013.01); *A46B 5/0029* (2013.01)

USPC ..... 15/167.1; 15/201

(58) Field of Classification Search

CPC ..... A46B 7/06; A46B 9/04

USPC ..... 15/167.1, 201

See application file for complete search history.

(56) References Cited

U.S. PATENT DOCUMENTS

| | | | | | |
|---|---|---|---|---|---|
| 4,240,452 | A | * | 12/1980 | Jean | 15/167.1 |
| 5,839,149 | A | * | 11/1998 | Scheier et al. | 15/167.2 |
| RE38,521 | E | * | 5/2004 | Halm | 15/167.1 |
| 8,020,244 | B2 | * | 9/2011 | Mashiko | 15/167.1 |
| 8,132,284 | B1 | * | 3/2012 | Kraemer | 15/167.1 |
| 2001/0014991 | A1 | * | 8/2001 | Halm et al. | 15/167.1 |

FOREIGN PATENT DOCUMENTS

| | | | |
|---|---|---|---|
| KR | 1998-014191 | * | 6/1998 |
| KR | 10-2006-0129064 | * | 12/2006 |
| KR | 10-2007-0037474 | * | 4/2007 |

* cited by examiner

*Primary Examiner* — Randall Chin

(74) *Attorney, Agent, or Firm* — Brundidge & Stanger, PC

(57) ABSTRACT

The present invention relates to a toothbrush, characterized by forming a hole perforated in an up-down direction on a header of a toothbrush, wherein the hole has placed therein a plate having a brush implanted thereon, and the plate is fixed on top of an elastic member fixed on the edge of the bottom surface portion of the header, so as to enable an elastic movement in up, down, left, right directions, and as the plate having the brush implanted thereon elastically moves similarly on the header according to the shapes of the teeth, the contact area between the teeth and the brush increases and the friction increases, to maximize the tooth brushing effect, minimizes the abrasion of the teeth and the damage of the periodontal tissues due to tooth brushing by adjusting the pressure exerted excessively on the teeth by a user, to enable an easier use of Bass tooth brushing techniques and to aid the user in achieving both cleanliness of gums and oral hygiene.

4 Claims, 6 Drawing Sheets

TOOTHBRUSH

TECHNICAL FIELD

The present invention relates to a toothbrush, and more particularly, to a toothbrush that is configured to allow a plate on which bristles are implanted to be elastically moved in a header in up, down, left and right directions according to the shapes of teeth, whereby the contact area between the teeth and the bristles and the friction force therebetween can be increased to maximize the tooth brushing effects, the abrasion of the teeth and the damage of the periodontal tissues due to tooth brushing can be minimized through the adjustment of the pressure exerted excessively on the teeth by a toothbrush user, and Bass tooth brushing technique helpful to patients with periodontal diseases can be adopted more easily to provide the cleanliness of gums, the health of periodontal tissues, and the oral hygiene to the toothbrush user.

BACKGROUND ART

Generally, a toothbrush used in conventional practices includes a flat plate-like header and bristles made of synthetic resin implanted on the header in such a manner as to be spaced apart from each other by a given distance, and accordingly, the bristles are different in length or diameter from each other so as to enhance the contact force with the teeth according to the curved surfaces of the teeth.

In the conventional practices, however, the bristles of the toothbrush are implanted erect on the flat plate-like header, and accordingly, the bristles are not elastically moved in accordance with the shapes of the teeth upon the tooth brushing, so that the contact area between the bristles and the teeth becomes small to cause the frictional forces of the bristles against the teeth to be not uniformly applied to the surfaces of the teeth when the tooth brushing is conducted, thereby undesirably decreasing the tooth brushing effects.

DISCLOSURE

Technical Problem

Accordingly, the present invention has been made in view of the above-mentioned problems occurring in the prior art, and it is an object of the present invention to provide a toothbrush that allows the contact area between bristles and teeth to be uniformly formed, irrespective of the shapes of the teeth, whereby the friction force between the bristles and the teeth can be increased to maximize the tooth brushing effects, the abrasion of the teeth and the damage of the periodontal tissues due to tooth brushing can be minimized through the adjustment of the pressure exerted excessively on the teeth by a toothbrush user, and Bass tooth brushing technique helpful to patients with periodontal diseases can be adopted more easily to provide the cleanliness of gums, the health of periodontal tissues, and the oral hygiene to the toothbrush user.

Technical Solution

To accomplish the above object, according to the present invention, there is provided a toothbrush including: a header having a hole perforated thereon in up and down directions; a plate adapted to be insertedly mounted into the hole in such a manner as to be separated by a given distance from the hole and having bristles implanted thereon; and an elastic member adapted to be fixed to the underside edges of the header in such a manner as to allow the plate fixed to the top surface thereof to be elastically moved in up, down, left and right directions.

Advantageous Effects

According to the present invention, the toothbrush is configured wherein the plate on which the bristles are implanted is mounted into the hole perforated in the up and down directions and then fixed to the top surface of the elastic member fixed to the underside edges of the header in such a manner as to be elastically moved in up, down, left and right directions, thereby performing the tooth brushing through the elastic movements of the plate corresponding to the various shapes of the teeth, whereby the contact area between the teeth and the bristles can be increased to maximize the tooth brushing effects, the abrasion of the teeth and the damage of the periodontal tissues due to tooth brushing can be minimized through the adjustment of the pressure exerted excessively on the teeth by a toothbrush user, and Bass tooth brushing technique helpful to patients with periodontal diseases can be adopted more easily to provide the cleanliness of gums, the health of periodontal tissues, and the oral hygiene to the toothbrush user.

BEST MODE FOR INVENTION

Figure 1:
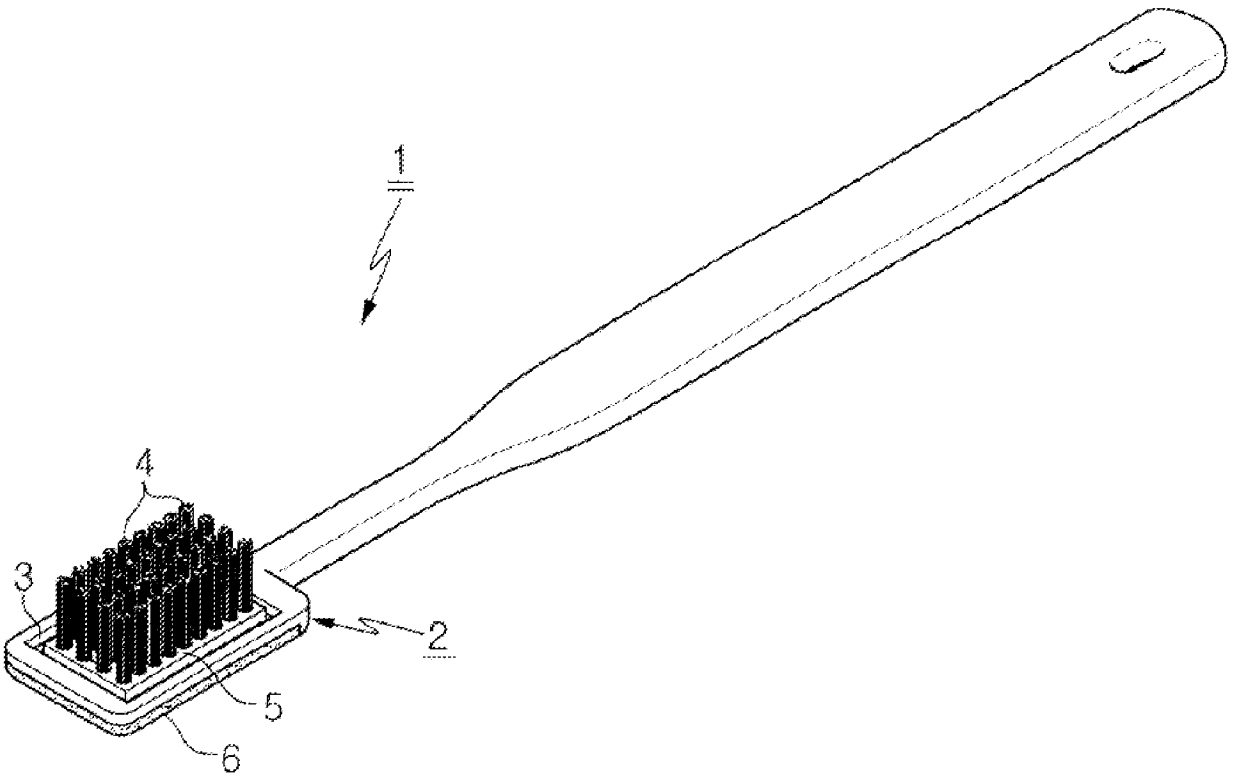
FIG. 1 is a perspective view showing a toothbrush according to an embodiment of the present invention.
Figure 2:
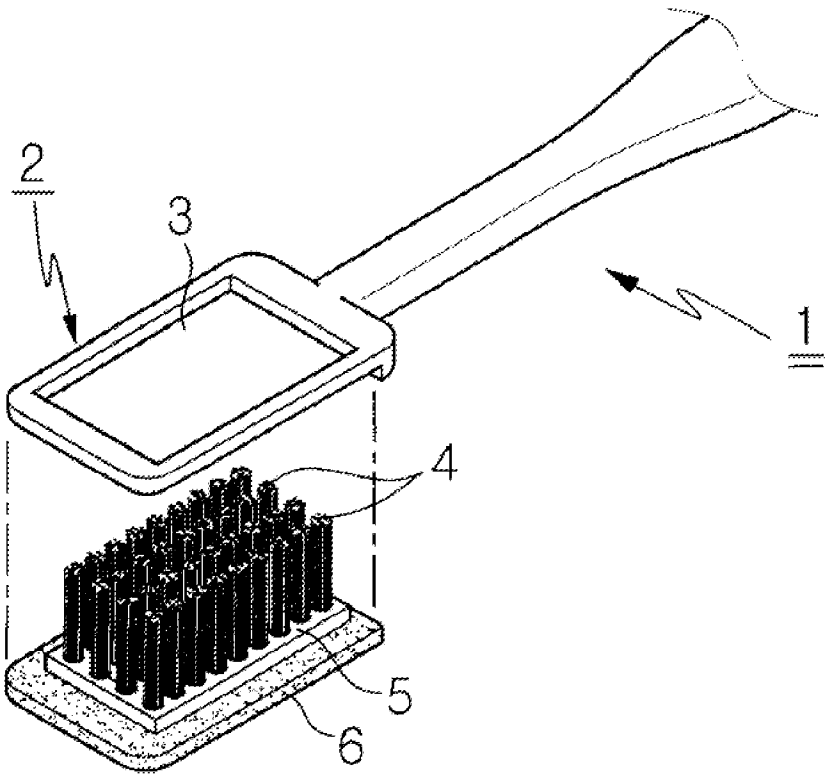
FIG. 2 is an exploded perspective view showing the main parts of the toothbrush according to the embodiment of the present invention.
Figure 3:
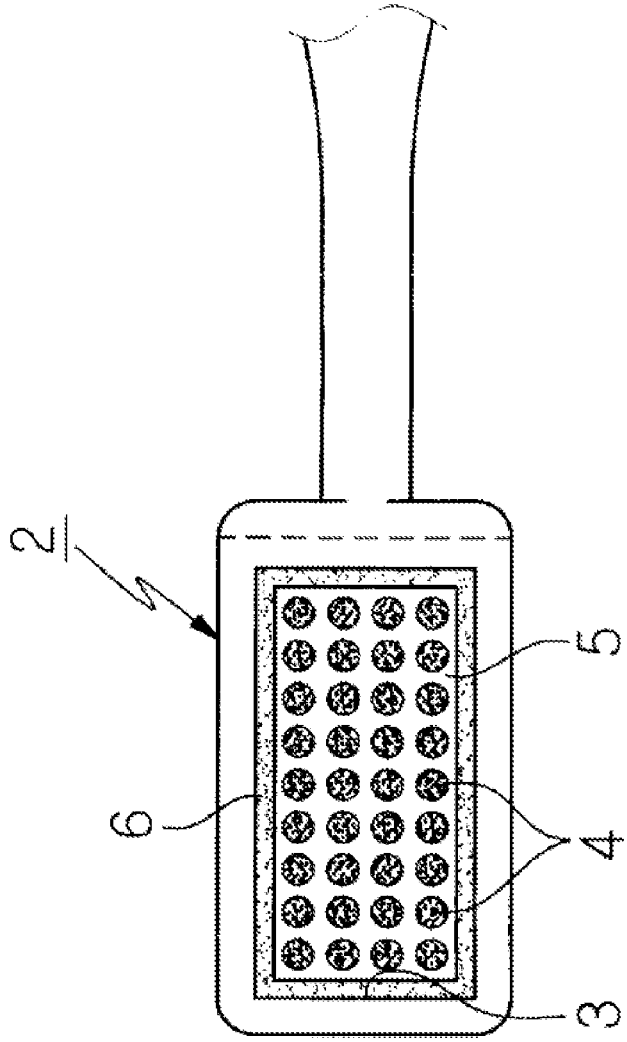
FIG. 3 is a plan view showing the main parts of the toothbrush according to the embodiment of the present invention.
Figure 4:
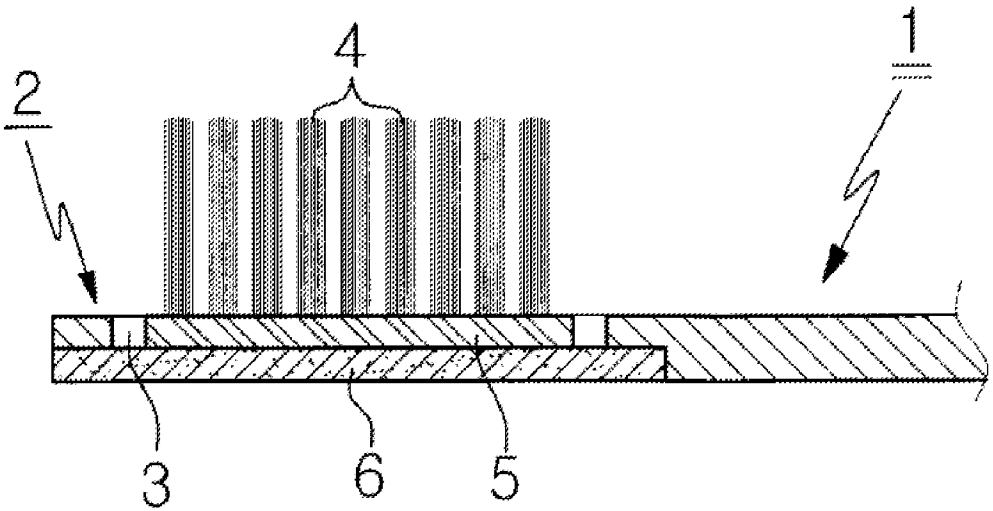
FIG. 4 is a sectional view showing the main parts of the toothbrush according to the embodiment of the present invention.

Hereinafter, an explanation on a toothbrush according to preferred embodiments of the present invention will be in detail given with reference to the attached drawings.

The present invention relates to a toothbrush 1 including: a header 2 having a hole 3 perforated thereon in up and down directions; a plate 5 adapted to be insertedly mounted into the hole 3 in such a manner as to be separated by a given distance from the hole 3 and having bristles 4 implanted thereon; and an elastic member 6 adapted to be fixed to the underside edges of the header 2 in such a manner as to allow the plate 5 fixed to the top surface thereof to be elastically moved in up, down, left and right directions according to the shapes of the teeth, whereby the contact area between the teeth and the bristles and the friction force therebetween can be increased to maximize the tooth brushing effects, the abrasion of the teeth and the damage of the periodontal tissues due to tooth brushing can be minimized through the adjustment of the pressure exerted excessively on the teeth by a toothbrush user, and Bass tooth brushing technique helpful to patients with periodontal diseases can be adopted more easily to provide the cleanliness of gums, the health of periodontal tissues and the oral hygiene to the toothbrush user.

MODE FOR INVENTION

According to the present invention, therefore, the hole 3 perforated on the header 2 has the width and height longer than those of the plate 5 on which the bristles 4 are implanted, and the plate-like elastic member 6 made of an elastic material such as soft synthetic resin, silicone, synthetic rubber and the like is fixed to the underside surface of the plate 5 by means of ultrasonic bonding.

The elastic member 6 has the width and height longer than those of the hole 3 and is fixed to the underside edges of the header 2 by means of ultrasonic bonding.

Figure 5:
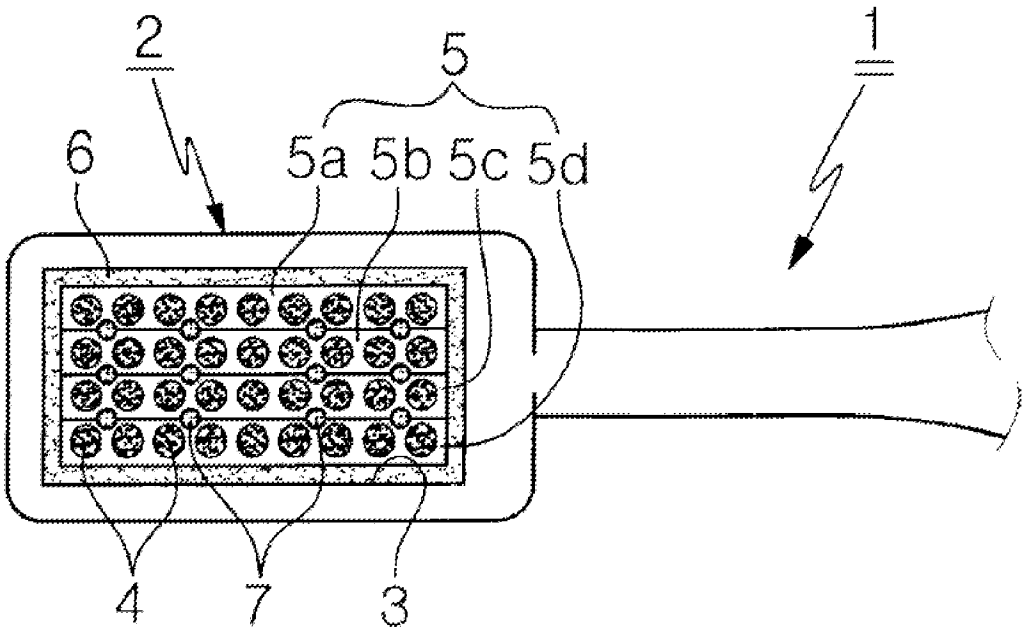
FIG. 5 is a plan view showing a toothbrush according to another embodiment of the present invention.
Figure 6:
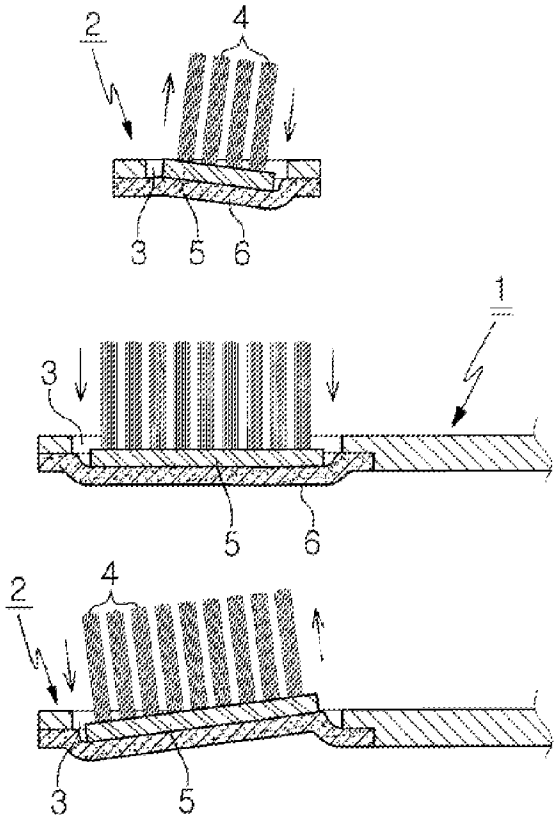
FIG. 6 is a side view showing the elastic movements in every direction of the toothbrush according to the preferred embodiments of the present invention.

On the other hand, as shown in FIG. 5, the plate 5 on which the bristles 4 are implanted may include a plurality of individual plates 5*a* to 5*d* formed in a plurality of rows in such a manner as to be connected with each other by means of a plurality of elastic connection members 7 taking the shapes of pins corresponding thereto, and after that, the plate 5 is fixed to top of the elastic member 6 by means of the ultrasonic welding. In addition to the shapes of the pins connecting the individual plates 5*a* to 5*d* with each other, the elastic connection members 7 may take the shapes of long bands or wires and other various shapes.

Further, as shown, the header 2 may have generally rectangular shape, long-oval shape, and other shapes, when viewed on a plane. If the header 2 has a long-oval shape, the hole 3, the plate 5 and the elastic member 6 have long-oval shapes, and unlike those as shown in FIG. 5, the individual plates 5*a* to 5*d* are longitudinally divided in a vertical direction or in a form of lattice in such a manner as to be connected with each other by means of the elastic connection members 7.

If tooth brushing is performed by using the toothbrush 1 according to the present invention, the plate 5 on which the bristles 4 are implanted is elastically moved in up, down, left and right directions according to the shapes of the teeth, so that the contact area between the teeth and the brush can be increased to maximize the tooth brushing effects.

This is ensured when the plate 5 on which the bristles 4 are implanted is fixed to top of the elastic member 6 fixed to the underside edges of the header 2. Since the plate 5 has the width and height shorter than the hole 3 perforated on the header 2, increasing the contact area between the teeth and the brush is further ensured by means of the elastic member 6 when the distance of the plate 5 from the hole 3 into which the plate 5 is elastically moved in up, down, left and right directions.

Moreover, as shown in FIG. 5, when the plate 5 has the individual plates 5*a* to 5*d* connected with each other by means of the plurality of elastic connection members 7 taking the shapes of pins corresponding thereto, the individual plates 5*a* to 5*d* are elastically moved in up, down, left and right directions by means of the elastic forces exerted from the elastic member 6 and the elastic connection members 7, so that the bristles 4 are moved according to the shapes of the teeth to enhance the contact area between the teeth and the bristles and the friction force therebetween, thereby maximizing the tooth brushing effects.

INDUSTRIAL APPLICABILITY

According to the present invention, the abrasion of the teeth and the damage of the periodontal tissues due to tooth brushing can be minimized through the adjustment of the pressure exerted excessively on the teeth by a toothbrush user, and Bass tooth brushing technique helpful to patients with periodontal diseases can be adopted more easily to provide the cleanliness of gums, the health of periodontal tissues, and the oral hygiene to the toothbrush user.

While the present invention will be described with reference to the particular illustrative embodiments, it is not to be restricted by the embodiment but only by the appended claims. It is to be appreciated that those skilled in the art can change or modify the embodiments without departing from the scope and spirit of the present invention.

The invention claimed is:

1. A toothbrush comprising:

a header having edges forming a hole perforated on the header in an up and down direction;

a plate insertedly mounted into the hole in such a manner as to be separated by a gap of a given distance from the edges that form the hole and having bristles implanted thereon; and an elastic member fixed to the underside edges of the header in such a manner as to allow the plate fixed on top thereof to be elastically moved in up, down, left and right directions.

2. The toothbrush according to claim 1, wherein the plate comprises a plurality of individual plates connected with each other by a plurality of elastic connection members.

3. The toothbrush according to claim 2, wherein the elastic member and the elastic connection members are made of one material selected from the group consisting of a soft synthetic resin material, silicone, and synthetic rubber.

4. The toothbrush according to claim 1, wherein the elastic member is made of one material selected from the group consisting of a soft synthetic resin material, silicone, and synthetic rubber.

* * * * *